United States Patent [19]

Klueh et al.

[11] Patent Number: 4,585,692

[45] Date of Patent: Apr. 29, 1986

[54] ALIPHATIC POLYURETHANE MATRIX TRANSFER MEDIUM AND POROUS MAGNESIUM SILICATE FILLER

[75] Inventors: David R. Klueh; Benjamin F. Livingston; James F. Martone; Martin J. Zutt, Jr., all of Lexington, Ky.

[73] Assignee: International Business Machines Corp., Armonk, N.Y.

[21] Appl. No.: 621,279

[22] Filed: Jun. 15, 1984

[51] Int. Cl.[4] ..... B41M 5/02

[52] U.S. Cl. ..... 428/317.9; 400/241.2; 428/206; 428/207; 428/318.4; 428/321.3; 428/331; 428/423.1; 428/423.7; 428/914

[58] Field of Search ..... 428/317.9, 321.3, 321.5, 428/331, 423.1, 423.7, 914, 206, 207, 318.4; 400/241.2

[56] References Cited

U.S. PATENT DOCUMENTS 3,037,879 6/1962 Newman et al. .
3,348,651 10/1967 Mater et al. .
3,413,184 11/1968 Findlay et al. .
3,681,186 8/1972 Findlay et al. .
3,849,239 11/1974 Newman ..... 428/321.3
4,544,292 10/1985 Klueh et al. ..... 400/241.2

FOREIGN PATENT DOCUMENTS 1217844 12/1970 United Kingdom ..... 428/914

OTHER PUBLICATIONS

*IBM Technical Disclosure Bulletin* article entitled "Ribbon with Modified Polyethylene Telephthalate Substrate," vol. 27, No. 1B, Jun. 1984, at pp. 639–640.

*Primary Examiner*—Bruce H. Hess
*Attorney, Agent, or Firm*—John A. Brady

[57] ABSTRACT

A matrix transfer medium with the binder being an aliphatic polyester polyurethane. This is formed directly on an untensilized polyethylene terephthalate film substrate. Porous magnesium silicate in minor amounts as a filler beneficially controls ink flow at printing. Overall good performance as to both ribbon feed and printing is realized.

10 Claims, No Drawings

ALIPHATIC POLYURETHANE MATRIX TRANSFER MEDIUM AND POROUS MAGNESIUM SILICATE FILLER

DESCRIPTION OF THE INVENTION

TECHNICAL FIELD

This invention relates to matrix transfer mediums or ribbons. In this field, resin is formed around a liquid ink forming a matrix similar to a filled sponge. In use, the ink is exuded under printing impacts. Such ribbons typically have a supporting substrate layer, which often is a different material from the matrix layer. The ribbon as a whole must function adequately during printing with respect to print quality, impact stability and ribbon advance or feed to present different ribbon areas for printing.

BACKGROUND ART

Matrix transfer mediums are now an established, commercial technology, but as print mechanisms change, existing transfer mediums may not be satisfactory. Typewriters and printers may require a low-friction outer substrate surface to facilitate feeding of the ribbon. Desirable and economic low friction surfaces may be polyolefins and polyesters, particularly polyethylene terephthalate.

Where such a surface is to be the substrate, a matrix formulation must be found to provide good print quality and stability under impact at reasonable cost. Such a formulation has been developed in accordance with this invention employing aliphatic polyurethane.

Polyurethane as the resin in a matrix transfer medium is an established alternative. Typically polyurethane is mentioned only generally in the prior art. U.S. Pat. Nos. 3,037,879 to Newman et al and 3,681,186 to Findlay et al are illustrative of such prior art. Neither mention a specific polyurethane for use, but do list polyurethane as a suitable material. U.S. Pat. No. 3,348,651 to Mater et al does teach the use of a specific urethane. That urethane is Estane polyurethane, an aromatic urethane. The only commercially sold polyurethane binder matrix ribbon known is believed from analysis to be an aromatic polyurethane.

The preferred embodiment of this invention includes a minor amount of a porous magnesium silicate filler. U.S. Pat. No. 3,413,184 to Findlay et al teaches talc as such a filler, as well as pigments and an oily ink vehicle as are conventional in this technology. Talc is naturally occurring magnesium silicate and is not porous. Significant novelty of this invention is believed to be in the aliphatic polyurethane and in the specific overall choice of materials. Significant novelty is also believed to be in the use of porous magnesium silicate as a filler.

DISCLOSURE OF INVENTION

This invention is a matrix transfer medium with the matrix resin binder being an aliphatic polyurethane with aliphatic parts having at least five linked carbon atoms. In the specific embodiment the polyurethane is a polyester polyurethane with aliphatic parts of more than six linked carbon atoms, which is soluble in a 1 to 1 mixture of isopropanol and toluene. Porous magnesium silicate in the resin binder has been found to significantly enhance printing characteristics. The ink vehicle is a mixture of lard oil and anhydrous lanolin. This matrix bonds directly on a substrate of polyethylene terephthalate film, which need not be tensilized. (A tensilized film is less elastic and a more elastic film conforms better to character images at impact.)

The polyurethane is formed around a colored fluid, which is the printing ink. As is conventional, under printing impact the resin deforms in conformance with the impact to apply the ink as printed images.

In the preferred formulation lanolin is included with a triglyceride oil to increase viscosity of the ink. Porous particulate magnesium silicate functions exceptionally well as a filler. The specific embodiment is formulated for the relatively low impacts of daisy wheel printing. For higher impacts, such as matrix printing by wire-dot impact, the proportion of resin is typically increased for higher resistance to destruction and the ink vehicle is typically reduced to reduce flow under the higher impacts.

BEST MODE FOR CARRYING OUT THE INVENTION

Formula

The following formula describes the fluid dispersion from which the preferred liquid transfer layer is made by expelling the isopropanol and toluene using heat.

| Ingredient | Part by Weight |
|---|---|
| Aliphatic polyurethane | 6.9 |
| Isopropanol | 38.65 |
| Toluene | 38.65 |
| Lard Oil | 6.5 |
| Lanolin (anhydrous) | 3.2 |
| Carbon black | 3.1 |
| Phthalocyanine Blue pigment | 1.9 |
| Porous magnesium silicate | 1.1 |
| | 100.0 |

The polyurethane is obtained commercially as "Q-Thane QI4692" lacquer, a product of K. J. Quinn, Co. That is a 25% by weight solution in equal parts by weight isopropanol and toluene. During subsequent processing, 28.3 parts by weight each of isopropanol and toluene are added to achieve the total of the first three ingredients.

Lard oil is a natural triglyceride oil. A suitable ingredient is the triple distilled, less than 25° F. pour point lard oil sold by Neatsfoot Oil Refining Co., Inc.

A suitable anhydrous lanolin is that sold by Emery Industries, Inc. as "Clearlan 1650".

Suitable carbon blacks are alkaline black "Monarch 800" and "Black Pearls 800" sold by Cabot Corporation. "Black Pearls 800" is the pelletized form of "Monarch 800".

Phthalocyanine blue pigment is Color Index No. 74160. A suitable blue is "Palomar Blue B-4708" sold by Mobay Chemical Co., Harmon Colors Division.

The preferred porous magnesium silicate is a synthetic magnesium oxide to silicon dioxide mixture in a ratio by weight of 1.0 to 2.75 of median particle size of 20 to 35 microns (which will be further reduced in size in a shot mill during manufacture of the transfer medium). This is obtained commercially as "Magnesol 30/40," a product of Pilot Engineering Company, Reagent Chemical Division. It is sold as a filtering and purifying agent. Natural magnesium silicate is not porous.

Process

The pigments (carbon black and blue), the filler (magnesium silicate), the oils (lard oil and lanolin), and 28.3 parts by weight each of the solvents (isopropanol and toluene) are added in a conventional, rotary-blade mixer and stirred thoroughly for 10 minutes. The resin lacquer (QI4692, 25 parts by weight solid) is then added, followed by 15 minutes of thorough mixing in the blade mixer.

This premix is then passed twice through a conventional sealed horizontal shotmill filled with 3 millimeters diameter stainless steel balls at a pressure differential of ½ bar. After these steps, agglomerates and particles are divided and dispersed and all ingredients in the formula are thoroughly mixed. This dispersion is held for later use in an agitated tank at 80° F. (About 25° C.).

This solution is coated on a untensilized polyethylene terephthalate film using a conventional three roll coater. In such a coater, two chromium-steel rolls are partially immersed in a pan with the closest point of their circumferences out of immersion and separated an amount defining the quantity to be coated. The rolls rotate oppositely, and one, the applicator roll, is contiguous to a rubber roll around which the substrate film is directed. The displacement between the applicator roll and the other, partially immersed roll, the metering roll, is set to apply a wet coating thickness of 3.3 mils (0.0825 mm) to the film at the rubber roll.

The line speed, the speed of lengthwise movement of the film through the three roll coater, is 100 feet per minute (about 30 meters per minute). The film is dried by forced air convection at a temperature range of 140°-200° F. (about 60°-93° C.). The foregoing steps and apparatus used are, in themselves, entirely conventional.

Product

The resulting product is a bulk matrix transfer medium which may be slit lengthwise and rolled as is typical for typewriter and printer ribbons. The matrix transfer medium has a regular cross section of the polyester support film, which typically is 0.2 to 0.4 mil thick (0.005 to 0.01 mm) and the matrix layer, which has a dry thickness of 0.7 mil (0.0175 mm).

Suitable polyester support film of the selected 0.2 to 0.4 mil thickness may be obtained commercially as 25S "Mylar" polyester film from E. I. Du Pont de Nemours & Co. It is a substantially untensilized (a stretching treatment). As the untensilized film is more elastic than the tensilized film, it conforms better on impact to print well-defined images. This untensilized film is less expensive and provides more impact-resistance than the tensilized film in the foregoing product.

Overall good performance in both ribbon feed and printing is realized.

The Polyurethane

Although full structural details of the polyurethane of the foregoing are not known, its aliphatic nature with carbon chain of more than five carbon atoms can be clearly established by nuclear magnetic resonance spectroscopy. No aromatic component appears. Dialiphatic ether components appear.

An equivalent, if not identical polyurethane, is available with current technology by reacting epsilon ($\epsilon$)-caprolactone with a low molecular weight diol (ethylene glycol or butylene glycol). This yields a straight-chain terminated by alcohol functional groups on each end with alternating six member carbon chains and short carbon chain in the internal ester functional groups. This diol is then reacted with 2,2,4 or 2,4,4 trimethyl hexamethylene diisocyanate (typically, a racemic mixture), which provides further polymerization, adds urethane functional groups and provides aliphatic parts having nine directly linked carbon atoms. This reaction is terminated by adding an amine, such as hexylamine, which reacts with the terminal isocyanate groups to terminate polymerization. Solvents, diluents, any catalysts and other intermediate ingredients are evaporated or washed out as convenient. The final product is the normally solid, aliphatic polyester polyurethane.

The Porous Magnesium Silicate

The magnesium silicate is trapped in the resin, as evidenced by the fact that none is in ink expelled from the ribbon during printing. Substitution of a solid magnesium silicate results in a notable deterioration in print quality. Accordingly, the porous characteristic is believed to function by holding ink and moderating its flow.

Limits

Substituting up to 25% by weight of an equivalent aromatic polyurethane yields adequate overall results as a transfer medium. Where any significant aromatic component is included, maintaining a thorough mixture of the fluid formula becomes difficult. Some aromatic polyurethanes yield products which are operable at up to 50% by weight with the aliphatic polyurethanes, but with noticeable reduction of print quality. The aromatic polyurethanes seem to hold the "Monarch 800" carbon black and preferentially release the "Palomar Blue" pigment.

Substituting up to 10% by weight of vinyl chloride/vinyl acetate resin of 86% vinyl chloride and 14% vinyl acetate copolymer, soluble in methylethyl ketone, does not significantly affect print quality.

It will be readily apparent that modifications of the specific formula described can be made without departing from the spirit and scope of this invention. Accordingly, patent coverage should be provided by law, with particular reference to the following claims.

We claim:

1. A matrix transfer medium comprising an aliphatic polyester polyurethane resin body holding a colored fluid ink in voids throughout said resin body and particulate porous magnesium silicate as a filler in said resin body, said resin body being deformable under impact to release said ink in printed images conforming to said impact.

2. The matrix transfer medium as in claim 1 in which said resin has aliphatic chains having greater than six carbon atoms.

3. The transfer medium as in claim 2 in which said ink has a liquid vehicle comprising a major part triglyceride oil and a minor part lanolin.

4. The transfer medium as in claim 3 comprising in the order of magnitude of 7 parts by weight of said polyurethane, 7 parts by weight of a triglyceride oil, 3 parts by weight of lanolin, 5 parts by weight of pigment, and 1 part by weight of porous magnesium silicate.

5. The transfer medium as in claim 4 also comprising an untensilized polyester film substrate.

6. The transfer medium as in claim 3 also comprising an untensilized polyester film substrate.

7. A matrix transfer medium comprising a polyester film substrate, an aliphatic polyester polyurethane resin body in contact with said substrate having voids throughout said resin body containing fluid ink, and a minor amount of particulate porous magnesium silicate as a filler in said resin body.

8. The matrix transfer medium as in claim 7 in which said resin has aliphatic chains having greater than six carbon atoms.

9. The transfer medium as in claim 8 in which said polyester substrate is untensilized.

10. The transfer medium as in claim 7 in which said polyester substrate is untensilized.

* * * * *